United States Patent [19]

Fischbach

[11] 4,012,896

[45] Mar. 22, 1977

[54] YARN FALSE TWISTER

[75] Inventor: Melvyn Robert Fischbach, Charlotte, N.C.

[73] Assignee: Fiber Industries, Inc., Charlotte, N.C.

[22] Filed: Nov. 17, 1975

[21] Appl. No.: 632,873

Related U.S. Application Data

[63] Continuation-in-part of Ser. No. 445,718, Feb. 25, 1974, abandoned.

[52] U.S. Cl. ..... 57/77.4

[51] Int. Cl.[2] ..... D02G 1/04; D01H 7/92

[58] Field of Search ..... 57/77.3–77.45, 57/156

[56] References Cited

UNITED STATES PATENTS

| | | | |
|---|---|---|---|
| 2,923,121 | 2/1960 | Tully | 57/77.4 |
| 3,073,136 | 1/1963 | Dean | 57/77.4 |
| 3,094,834 | 6/1963 | Deeley et al. | 57/77.4 X |
| 3,287,890 | 11/1966 | McIntosh et al. | 57/77.4 |
| 3,705,488 | 12/1972 | Sholly et al. | 57/77.4 |
| 3,724,196 | 4/1973 | Holland et al. | 57/77.4 |
| 3,762,149 | 10/1973 | Raschle | 57/77.4 |
| 3,820,317 | 6/1974 | Raschle | 57/77.4 |
| 3,875,734 | 4/1975 | Dupeuble | 57/77.4 |
| 3,885,378 | 5/1975 | Schuster | 57/77.4 |
| 3,901,011 | 8/1975 | Schuster | 57/77.4 |

*Primary Examiner*—Donald Watkins

[57] ABSTRACT

An apparatus and process for disc type friction false twisting, the disc having an inorganic yarn-engaging surface, with a critical surface texture of more than 75 and less than 400 peaks of at least 50 microinches in height per linear inch and a hardness greater than 975 on the $Knoop_{100}$ scale. Preferably, the apparatus is an intermeshing disc friction false twist apparatus.

22 Claims, 5 Drawing Figures

YARN FALSE TWISTER

The present invention, which is a continuation-in-part application of copending application Ser. No. 445,718 filed Feb. 25, 1974 now abandoned, relates to an apparatus and process for false twisting a textile yarn and more specifically for high speed friction false twist texturing multifilament textile denier yarn suitable for fabric constructions, particularly knit and woven goods.

It is known that some of the separate process stages of producing textured yarn from polymer may be combined to provide not only higher productivity, but an improved product as well. One of the most efficient processes currently employed by a fiber producer is to operate in two stages: first is the production from polymer of spun or partially drawn multifilament fiber; and, second, to simultaneously draw-texture the filament yarn. In brief, this second stage process feeds the yarn of textile denier into a false twist zone consisting sequentially of a heater, a false twister and a draw roll, the latter operating at a speed sufficient to draw the yarn at the desired draw ratio. The false twist backs up into the heated zone to a draw neck point located therein, wherein the twist is set into the yarn. The yarn may be packaged as a stretch yarn or sequentially, and in a continuous manner, overfed through a second heater zone and then packaged. The false twisting apparatus employed in such processes has been conventional spindle false twisting devices such as are set forth in U.S. Pat. Nos. 2,089,199 and 2,777,276. Such devices while capable of producing satisfactory textured yarn products have limited running speed. For example, 158 denier polyester with a false twist level of 64 turns per untwisted inch is generally not draw-textured faster than about 670 feet per minute because higher speeds would require too high a spindle revolution per minute for the spindle to remain stable in its mounting. For a given TPI (turns per untwisted inch) the production rate of the draw-texture stage employing spindle false twisting is dictated by the operating speed of the spindle that inserts the twist. Since fiber spinning speeds in the first stage may be as great as 12,000 feet per minute, the second stage becomes the limiting factor to high productivity.

Friction false twist devices, which are capable of exceeding spindle false twist speeds, subject a running yarn to a rotational force by contacting the surface of the yarn to a rotating disc or a rotating bush member. Friction false twist devices with which the instant invention is concerned are rotating disc devices. False twist devices of the prior art which are characterized by employing intermeshing disc members, the yarn-contacting surfaces of which have a high coefficient of friction, are set forth in U.S. Pat. Nos. 2,939,269 and 2,923,121. The inherent disadvantage of these prior art devices is that they utilize a twisting surface that is smooth and resilient in order to obtain the high coefficient of friction necessary to impart the required twist to the filament yarn as it traverses the surface. Typically, 65 to 85 Shore A scale durometer polyurethanes are used as the twister surface material. However, such materials are susceptible to inadvertent cutting by plant operating personnel and chemical attack by spin finish both of which change the surface properties and hence operating conditions and product properties. Moreover, for other than hosiery deniers, such materials are prone to rapid wear. Also, such materials, because of their softness, may not retain their dimensional stability when operated at high speed. Thus while capable of avoiding the speed limitation of spindle twisting, existing friction devices can lose the economic advantage of high-speed texturing due to the high cost of frequent replacement and concomitant machine downtime. Harder materials such as 90 to 100 durometer polyurethane, while having better wear characteristics, do not have the surface frictional properties necessary to impart the required twist level to yield a product of sufficient bulk. Metals commonly used in the textile industry such as polished chrome or matt chrome, like the hard polyurethanes, do not impart sufficient twist. Some softer metals such as aluminum may impart sufficient twist but are unacceptable due to their brief durability.

It is therefore an object of this invention to provide a disc type friction false twisting apparatus, the discs of which have durable, yarn finish resistant surfaces which will impart high yarn twist levels and adequate yarn physical properties.

It is another object of this invention to provide a high speed process for friction false twisting yarn.

In accordance with this invention, it has been discovered that a disc type friction false twist device having an inorganic yarn-engaging surface, with a critical surface texture and a hardness greater than 975 on the $Knoop_{100}$ scale will greatly improve the runability of a friction false twist device. Preferably, the yarn engaging surface of the disc has a coefficient of friction sufficient to grip and torque a yarn being processed. Most preferably, the disc has a coefficient of friction of at least 0.28 and even more, preferably a coefficient of friction of at least 0.31. The disc type friction false twist device is an intermeshing disc friction false twist device, the discs of which have a refractory surface. The device should be capable of producing a twist factor of not less than 630 to a filament thread line running at a speed in excess of about 1000 feet per minute. Twist factor is defined as the product of number of turns per untwisted length and square root of the yarn denier; e.g. with 158 denier, a twist factor of 630 corresponds to 50 TPI. The surface texture is defined by a measurement obtained from the vertical motion of a stylus the electronic signal of which is amplified and recorded as it is pulled slowly and horizontally over the surface to be measured. A complete description of surface texture and means for obtaining this measurement appears in "Surface Texture" ASA B46-1-1962, published by the American Society of Mechanical Engineers, 345 East 47th Street, New York City, N.Y. As noted in the aforementioned article, surfaces in general are very complex in character.

A detailed description is also given in the referenced article of stylus type instruments using stylus tracers and electrical amplification with specific standards being set for stylus design, stylus force, stylus support, tracer head supports and traversing length as well as for the electronic amplification and recording systems. The measurements made for purposes of this invention deal only with peak density.

A specific piece of equipment which has been found to be especially suitable for purposes of this invention is the "Tallysurf 4" marketed by Rank Precision Industries. The stylus should traverse the sample surface at 0.14 inch/minute and cover 0.4 inch of surface. The stylus motion is magnified 2000X in the direction of the surface irregularities and 100X in the traversing direction of the stylus. In this way a 40 inch record of the surface texture is produced, requiring approximately 3 minutes. Such records are obtained at ten different positions on the sample of interest. The number of peaks of at least 50 microinches in height over the entire length of the printout sheet are counted. Friction twist surface textures suitable for purposes of this invention are found to have more than 75 and less than 400 peaks per inch of sample surface and preferably from 175 to 350 peaks per inch of sample surface.

Using a Rothschild Friction Tester marketed by Lawson-Hemphill Sales, Inc., P.O. Box 2406, Spartanburg, S.C. 29302, one hundred seventy denier, thirty-six filament false twist textured heat set poly(ethylene terephthalate) yarn (Fiber Industries, Incorporated Lot No. 17514) is passed in an axial plane across the edge of the disc of interest at a running speed of 200 meters per minute under a pretension of 25 grams, the yarn having previously been conditioned for ten hours in an environment controlled at 72° F. and 20% relative humidity. A measurement of the exit tension is then obtained from the Rothschild Friction Tester which is operated in an environment controlled at 72° F. and 20% relative humidity and the coefficient of friction $\mu$ is computed according to the formula:

$$\text{exit tension} = \text{pretension } (e^{\ \Theta \mu})$$

where $e = 2.718$ (base of the natural system of logarithms) and $\theta$ is the accumulative angle of wrap expressed in radians, that is to say, the cumulative distance on the edge of the disc that is in contact with the moving yarn. At least three runs should be made with the disc being turned to expose a fresh surface each run, the reported coefficient of friction being the average value of these runs. While a specific yarn has been specified in the foregoing test procedure, it should be understood that one hundred seventy denier poly(ethylene terephthalate) false twist textured heat set yarns having from 30 to 40 filaments may also be employed without substantially varying the test results.

The term "disc" as employed herein is deemed to include any rotational member wherein a yarn engaging friction surface is provided on the outer periphery thereof. The discs may also comprise two or more longitudinally spaced, coaxial portions, the arrangement being such that the yarn is deflected slightly from its normal direction of travel by the intrusion between two such coaxial portions. The coaxial portions may consist of a single casting or machined portion or may be a plurality of disc members coaxially secured to a shaft.

The term "refractory" as employed herein is deemed to include inorganic materials which have a hardness on the $\text{Knoop}_{100}$ scale in excess of 975 and preferably in excess of 1700. Included in this category are carbides such as chromium carbide and tungsten carbide, borides such as TiB, $TiB_2$, ZrB and MoB and nitrides such as iron, chromium or nickel nitride. Preferably, the refractory material is a refractory metal oxide. Refractory metal oxides are deemed to include mixed oxides and spinels, such as Mg $Al_2O_4$ and Zn $Al_2O_4$ metal aluminates, metal titanate, metal vanadates, metal chromites, and metal zirconates. Specific examples of silicates include sodium aluminum silicate, calcium aluminum silicate, calcium magnesium silicate, calcium chromium silicate, and calcium silicate titanate. Specific examples of single oxides include $Y_2O_3$, $La_2O_3$, BeO, $TiO_2$, $HfO_2$, $Al_2O_3$, $ZrO_3$, BaO, $TiO_2$, $SiO_2$, $Ta_2O_5$, $Cr_2O_3$. Most preferably, the refractory metal oxide is $Cr_2O_3$.

A better understanding of the invention may be had from a discussion of the drawings wherein.

Figure 1:
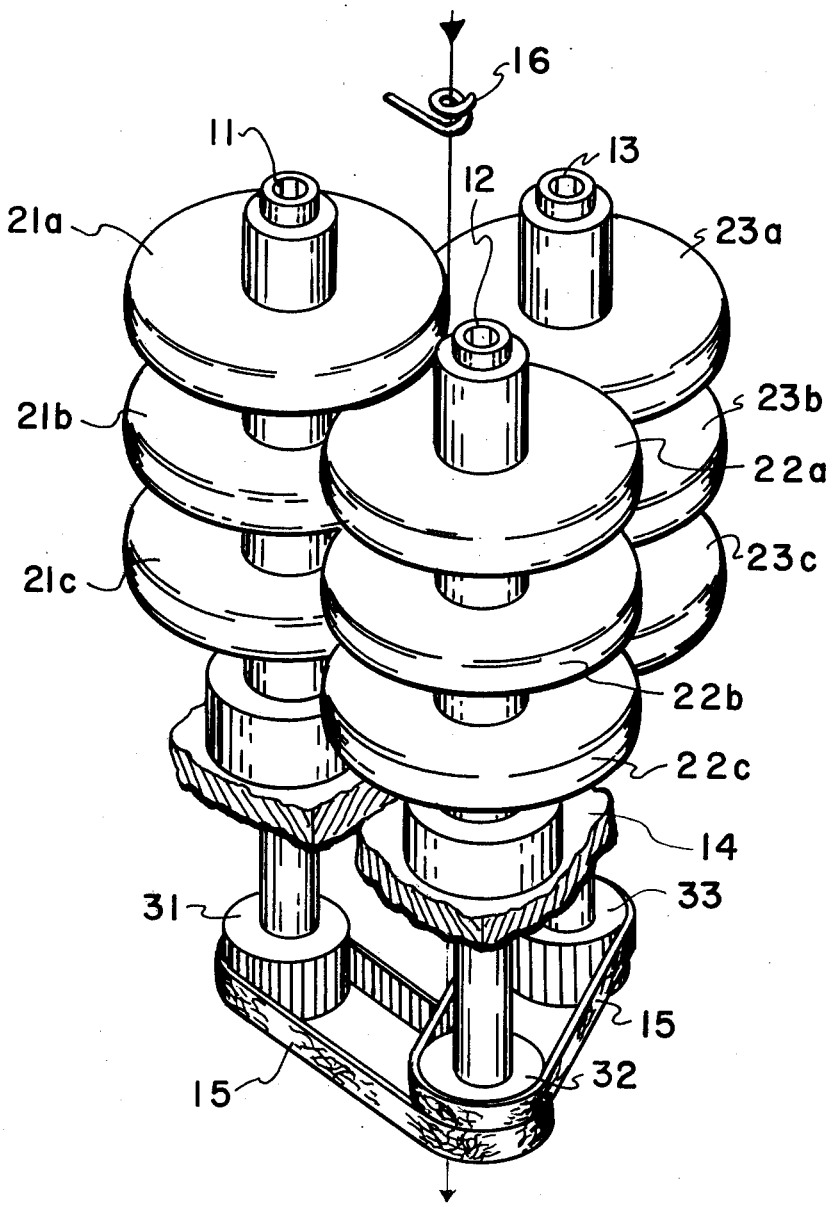
FIG. 1 is a projected view of a friction false twisting apparatus.

Turning to FIG. 1 of the drawings, a friction false twisting arrangement for a yarn comprises three parallel aligned shafts 11, 12, and 13, each shaft carrying three discs identified as 21*a*, 21*b*, and 21*c* for shaft member 11; 23*a*, 23*b*, and 23*c* for shaft member 13; 22*a*, 22*b*, and 22*c* for shaft member 12. Shaft members 11, 12, and 13 are supported in broken away housing member 14, each of said shaft member 11, 12, and 13 having pulley members 31, 32, and 33 respectively secured thereto. Belt members 15 pass around a driving pulley 32, belt members 15 contacting pulley member 31 and 33 thereby causing shaft members 11, 12, and 13 and their respective discs to rotate. Yarn passing through a guide eye 16 and then between the intermeshing discs of shaft members 11, 12, and 13 is caused to rotate about its axis in the opposite direction of rotation as the discs while the yarn travels in a downward direction. As can be seen two discs form a guide for the yarn being processed while a third disc forces the yarn into engagement with said two discs. While more than three discs and more than three longitudinally spaced coaxial disc portions may be employed in intermeshing disc friction false twist devices, the preferred number of discs for use in conjunction with this invention is nine mounted on three longitudinally spaced shaft members. The number of discs used affects the twist level, more discs producing more twist, however no significant gain in twist is achieved by using more than nine or ten, each disc having the same surface texture. Additional discs with different surface textures may be used; for example, polished discs, which act to produce the correct yarn entry or exit angle although not contributing measurably to the insertion of twist.

Figure 2:
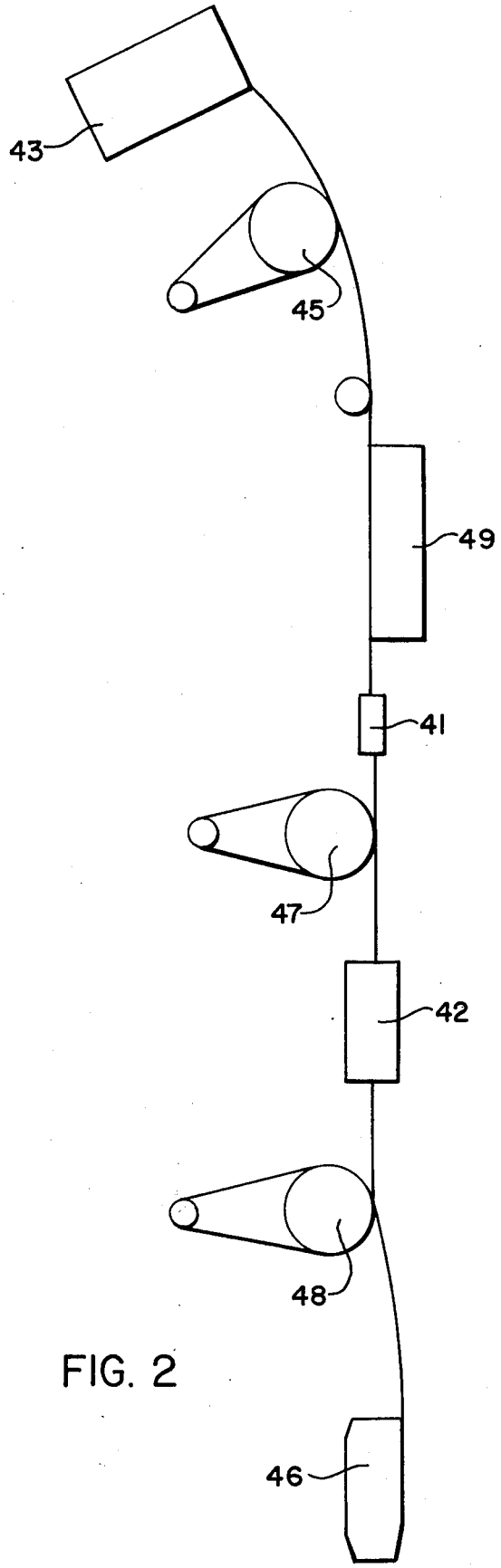
FIG. 2 is a schematic illustration of a friction false twist process.

A processing sequence to which the yarn may be subjected can be described by turning to FIG. 2 of the drawings wherein yarn is supplied from a supply package 43 to the draw texturing operation. The undrawn or partially drawn yarn having a producer twist of about zero turns per inch is pulled off the supply package by positively controlled feeder supply. Positively controlled feed roll 45 and draw roll 47 are operated at speeds such that the yarn is drawn appropriate to the orientation of the yarn, for example 290 denier spun yarn with a birefringence of $30 \times 10^{-3}$ would be drawn 1.88, based on feed and draw roll surface linear speeds. Hot plate 49 which is heated by suitable internal means and is of a length appropriate to provide sufficient heat for the yarn processing speed is maintained at elevated temperature. Friction false twist assembly 41 is rotated by means not shown at speeds sufficient to provide appropriate yarn tension, e.g. a speed ratio of 1.70.

Speed ratio is the ratio of disc surface speed to yarn processing speed. False twist is inserted by the friction twist device and false twist is propagated in the yarn back from the friction false twist device to the draw point, located on the heater 49, thus setting the yarn in a twisted configuration. For purposes of this invention, the direction in which the yarn traverses the heater is not considered critical as long as adequate yarn cooling means are present. The yarn may be packaged after being subjected to the friction false twist device or alternatively passed over a second hot plate 42, relax roll 48 and packaged on a suitable take-up device 46. While the foregoing description has been directed toward a draw texturing process, it should be understood that fully drawn yarns are also suitable for processing in this invention.

As previously noted, satisfactory yarns can only be produced on friction false twist assemblies at the running speeds contemplated herein by using disc members having a surface texture and hardness within the prescribed limits. While the invention is concerned with the surface characteristics of the disc member it should be understood that the disc member may be either a refractory disc such as a solid ceramic disc or alternatively a metallic disc having a refractory coating deposited thereon. The preferred disc member for purposes of this invention is a metal disc having a refractory metal oxide coating flame sprayed thereon. The coated surface is then buffed until the desired surface texture is reached.

While a variety of refractory coating processes may be employed in preparing the disc member of this invention, it is preferred to use powdered refractory material flame sprayed onto a metal substrate. This process consists of heating the powdered refractory material to a semi-molten condition by passing it through a high temperature heat source, and depositing it in a finely divided form on a substrate. The semi-molten particles flatten out on impacting the substrate and adhere to its surface. A high velocity blast of air or other gas is used to propel the particulate coating through a heat source such as the ultra high heat source which can be achieved with an electrically generated plasma arc. A detailed description of this coating process is set forth on pages 507 to 515 of Metals Handbook, Volume II, eighth edition, published by American Society for Metals, Copyright 1964. The surface may then be buffed by any of the well known finishing techniques.

The following specific examples set forth the process of this invention.

EXAMPLE I

Figure 3:
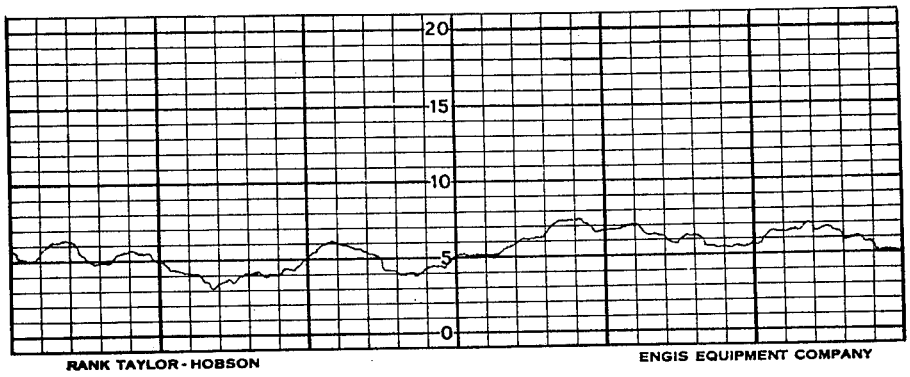
FIG. 3 is a partial section of a stylus printout sheet of a disc having a smooth and unsatisfactory surface texture.
Figure 4:
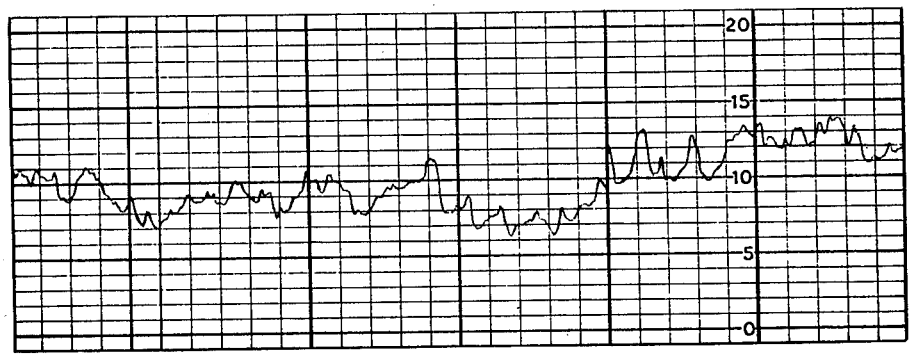
FIG. 4 is a partial section of a stylus printout sheet of a disc having the surface texture of this invention.
Figure 5:
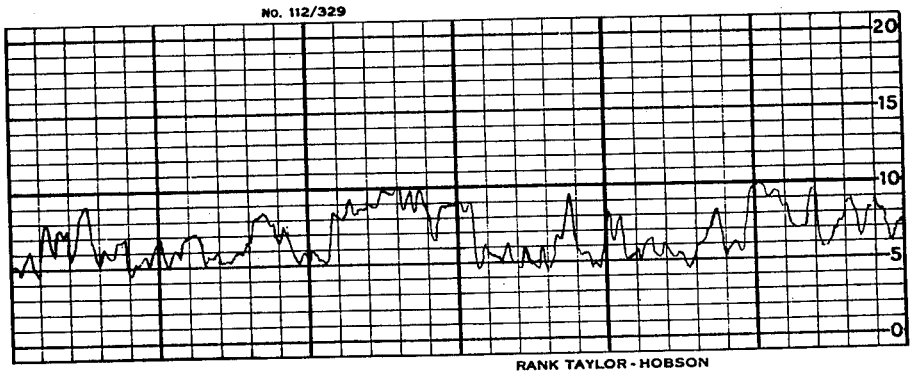
FIG. 5 is a partial section of a stylus printout sheet of a disc having a rough and unsatisfactory surface.

A continuous filament polyethylene terephthalate yarn having a total as spun denier of 290 is passed in a partially drawn condition into the processing sequence set forth in FIG. 2 of the drawings. The yarn is passed over a feedroll at a speed of 530 feet per minute and then across a heater operated at a temperature of 240° C, through a cooling region, into the intermeshing disc friction false twist apparatus as illustrated in FIG. 1 of the drawings and then around a drawroll operated at a speed of 1000 feet per minute. All of the friction discs are aluminum having a $Cr_2O_3$ coating disposed on the yarn contacting surfaces. The 282 peaks per inch surface characteristics of the $Cr_2O_3$ surface are as characterized in FIG. 4 of the drawings wherein a vertical deflection of one small scale division is 50 microinches, the scale being common to FIGS. 3 and 5 as well. The discs are also found to have a coefficient of friction of 0.39 and a $Knoop_{100}$ hardness of 1900. The friction false twist apparatus is operated at 1680 feet per minute disc peripheral speed resulting in an input tension of 34 grams and an output tension of 41 grams whereby 57 turns per inch of false twist are obtained. The yarn properties are acceptable and are found to be as follows:

| | |
|---|---|
| Skein Shrinkage | 36% |
| Denier | 160 (36 filaments) |
| Tenacity | 3.86 grams per denier |
| Elongation | 25% |

EXAMPLE II

A continuous filament nylon 6.6 yarn is passed in an undrawn condition into the processing sequence set forth in FIG. 2 of the drawings. The yarn is passed over a feedroll and then across a heater operated at 200° C through a cooling zone, into the intermeshing disc friction false twist apparatus of Example I and then around a draw roll operated at 1000 feet per minute so as to provide a 2.5 draw ratio. The friction false twist apparatus is operated at a disc peripheral speed of 1580 feet per minute employing an input tension of 29 grams and an output tension of 31 grams whereby 69 turns per inch of false twist is obtained. The yarn which is packaged after texturing has properties which are acceptable and are found to be as follows:

| | |
|---|---|
| Skein Shrinkage | 30% |
| Denier | 98.8 (34 filaments) |
| Tenacity | 2.85 grams per denier |
| Elongation | 38.9% |

EXAMPLE III

A continuous filament polyethylene terephthalate yarn is passed in a partially drawn condition into the processing sequence set forth in FIG. 2 of the drawings. The yarn is passed over a feedroll, across a heater operated at 220° C, through the cooling zone, into the friction false twist apparatus as set forth in Example I operated at a disc peripheral speed of 2180 feet per minute and then around a draw roll operated at 1200 feet per minute so as to provide a 1.88 draw ratio. Input tension of 24 grams and an output tension of 33 grams are employed whereby 80 turns per inch of false twist will be obtained. The yarn is then passed from said friction twist apparatus over a second heater operated at a temperature of 200° C prior to packaging. The yarn properties are acceptable and are found to be as follows:

| | |
|---|---|
| Stretch Skein Shrinkage | 40% |
| Set Skein Shrinkage | 12% |
| Denier | 86 (30 filaments) |
| Tenacity | 3.60 grams per denier |
| Elongation | 22.4% |

EXAMPLE IV

A continuous filament polyethylene terephthalate yarn is passed in a partially drawn condition into the processing sequence set forth in FIG. 2 of the drawings. The yarn is passed over a feedroll at a speed of 1060 feet per minute, across a heater operated at a temperature of 250° C through a cooling region, into the friction false twist apparatus of Example I, and then around a draw roll operated at a speed of 2000 feet per minute. The input tension is 35 grams, output tension is 46 grams. The disc peripheral speed is 3630 feet per minute whereby 54 turns per inch of false twist are obtained. The yarn properties are acceptable and are found to be as follows:

| | |
|---|---|
| Skein Shrinkage | 31% |
| Denier | 161 (36 filaments) |
| Tenacity | 3.66 grams |
| Elongation | 25% |
| Skein Shrinkage | 40% |
| Denier | 160 |
| Tenacity | 4.3 grams |
| Elongation | 21.4% |

The following comparative examples set forth the advantages of the process and apparatus of this invention. The examples, however, are given for purposes of illustration and should not be considered as limiting the spirit or scope of this invention.

EXAMPLES VI–XIV

By means of the nine disc apparatus illustrated in FIG. 1 and the yarn string-up procedure discussed in conjunction with FIG. 2, 36 filament round cross section polyethylene terephthalate yarn is processed employing a single hot plate at a temperature of about 240° C and the various operating conditions given in the following table.

| EXAMPLE | DISCS | Coefficient of Friction | Peaks 50 Microinch | Input Tension | Output Tension | Disc Peripheral Speed | Process Speed | Turns Per Inch | $Knoop_{100}$ Hardness | Tenacity Grams/ Denier |
|---|---|---|---|---|---|---|---|---|---|---|
| VI | Silicon Carbide Coated Aluminum | ~.45 | 472 | 25 Grams | 50 Grams | 1560 fpm* | 1000 fmp* | 61 | 2585 | 2.41 |
| VII | Titanium Carbide Coated Aluminum | ~.45 | 417 | 25 Grams | 29 Grams | 1570 fpm* | 750 fpm* | 61 | 2955 | 2.43 |
| VIII | Chromium Oxide Coated Aluminum | .43 | 350 | 26 Grams | 48 Grams | 1570 fpm* | 1000 fpm* | 58 | 1900 | 3.33 |
| IX | Chromium Oxide Coated Aluminum | .39 | 282 | 26 Grams | 48 Grams | 1570 fpm* | 1000 fpm* | 58 | 1900 | 3.60 |
| X | Chromium Oxide Coated Aluminum | .39 | 282 | 37 Grams | 37 Grams | 2320 fpm* | 1000 fpm* | 63 | 1900 | 3.61 |
| XI | Solid Ceramic Aluminum Oxide | .34 | 241 | 35 Grams | 45 Grams | 1780 fpm* | 1000 fpm* | 57 | 1700 | 3.85 |
| XII | Chromium Oxide Coated Aluminum | .28 | 182 | 40 Grams | 50 Grams | 1930 fpm* | 1000 fpm* | 55 | 1900 | 4.20 |
| XIII | Chromium Oxide Coated Aluminum | .28 | 71 | — | — | — | — | 0 | 1900 | 0 |
| XIV | Chromium Metal Plated Aluminum | .27 | 285 | 90 Grams | 110 Grams | 2500 fpm* | 1000 fpm* | 8 | 975 | 3.85 |

*Feet per minute

EXAMPLE V

A continuous filament fully drawn polyethylene terephthalate yarn is passed into processing sequence set forth in FIG. 2 of the drawings. The yarn is passed over a feedroll at a speed of 700 feet per minute, across a one meter heater operated at a temperature of 240° C, through a cooling region, into the friction false twist apparatus of Example I, and then around a draw roll operated at a speed of 710 feet per minute. The input tension is 33 grams and output tension is 40 grams. The disc peripheral speed of 1293 feet per minute gives 57 turns per inch of false twist. The yarn properties are acceptable and are found to be as follows:

As can be seen from the table, Examples VI and VII which are representative of discs having a surface texture which is too rough, i.e. 472 and 417 respective peaks per inch of sample, produced an unacceptable end product. The stylus printout sheet of the unacceptable disc surface of Example VI is characterized by FIG. 5 of the drawings. Example XIII which is representative of discs having a surface texture which is too smooth; i.e. 71 peaks per inch of sample, resulted in an inoperative process. The stylus printout sheet of this unacceptable disc surface is characterized by FIG. 3 of the drawings. In closing, it should also be noted that Example XIV is representative of a disc having insufficient hardness which results in an unacceptable amount of twist being placed in the yarn.

What is claimed is:

1. In a friction false twist device of the disc type, mounted on three shaft members, the improvement comprising a disc member having an inorganic yarn-engaging surface on the outer periphery thereof, said surface having a hardness greater than 975 on the $Knoop_{100}$ scale and a surface texture of more than 75 and less than 400 peaks of at least 50 microinches in height per linear inch.

2. The apparatus of claim 1 wherein said friction false twist device is an intermeshing disc friction false twist device.

3. The apparatus of claim 1 wherein said surface texture is more than 175 and less than 350 peaks of at least 50 microinches in height per linear inch.

4. The apparatus of claim 1 wherein said disc member is a solid refractory disc.

5. The apparatus of claim 1 wherein said disc member is a metal disc with a refractory coating thereon.

6. The apparatus of claim 5 wherein said coating is $Cr_2O_3$.

7. The apparatus of claim 2 having nine intermeshing discs disposed in coaxial groups of three on three shaft members, said shaft members being in parallel alignment.

8. In a friction false twist device of the disc type mounted on three shaft members, the improvement comprising a disc member having an inorganic yarn-engaging surface on the outer periphery thereof, said surface having a hardness greater than 975 on the $Knoop_{100}$ scale, a coefficient of friction sufficient to grip and torque a yarn being textured and a surface texture of more than 75 and less than 400 peaks of at least 50 microinches in height per linear inch.

9. The apparatus of claim 8 wherein said friction false twist device is an intermeshing disc friction false twist device.

10. The apparatus of claim 8 wherein said surface texture is more than 175 and less than 350 peaks of at least 50 microinches in height per linear inch.

11. The apparatus of claim 8 wherein said disc member is a solid refractory disc.

12. The apparatus of claim 8 wherein said disc member is a metal disc with a refractory coating thereon.

13. The apparatus of claim 12 wherein said coating is $Cr_2O_3$.

14. The apparatus of claim 9 having 9 intermeshing discs disposed in coaxial groups of three on three shaft members, said shaft members being in parallel alignment.

15. In a friction false twist device of the disc type, mounted on three shaft members, the improvement comprising a disc member having an inorganic yarn-engaging surface on the outer periphery thereof, said surface having a hardness greater than 975 on the $Knoop_{100}$ scale, a coefficient of friction of not less than 0.28 and a surface texture of more than 75 and less than 400 peaks of at least 50 microinches in height per linear inch.

16. The apparatus of claim 15 wherein said coefficient of friction is not less than 0.31.

17. The apparatus of claim 15 wherein said friction false twist device is an intermeshing disc friction false twist device.

18. The apparatus of claim 15 wherein said surface texture is more than 175 and less than 350 peaks of at least 50 microinches in height per linear inch.

19. The apparatus of claim 15 wherein said disc member is a solid refractory disc.

20. The apparatus of claim 15 wherein said disc member is a metal disc with a refractory coating thereon.

21. The apparatus of claim 20 wherein said coating is $Cr_2O_3$.

22. The apparatus of claim 17 having nine intermeshing discs disposed in coaxial groups of three on three shaft members, said shaft members being in parallel alignment.

* * * * *

UNITED STATES PATENT OFFICE

CERTIFICATE OF CORRECTION

Patent No. 4,012,896 Dated March 22, 1977

Inventor(s) Melvyn Robert Fischbach

It is certified that error appears in the above-identified patent and that said Letters Patent are hereby corrected as shown below:

In the table following Examples VI-XIV spanning columns 7 and 8, the third heading read:

"Peaks
50
Microinch"

should read -- Peaks
$\geq$ 50
Microinch --.

Signed and Sealed this
Thirty-first Day of May 1977

[SEAL]

*Attest:*

RUTH C. MASON
*Attesting Officer*

C. MARSHALL DANN
*Commissioner of Patents and Trademarks*